US006275126B1

(12) United States Patent
Martelli et al.

(10) Patent No.: US 6,275,126 B1
(45) Date of Patent: Aug. 14, 2001

(54) MOLDED CASE POWER SWITCH WITH SECONDARY COVER REMOVABLY SECURED BY QUICK RELEASE FASTENERS

(75) Inventors: Dominic P. Martelli, McKees Rocks; Trent Allen Chontas, Pittsburgh; Richard Paul Malingowski, Finleyville; William David Munsch, Pittsburgh, all of PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/544,832

(22) Filed: Apr. 6, 2000

(51) Int. Cl.[7] ..... H01H 9/02
(52) U.S. Cl. ..... 335/202; 200/293
(58) Field of Search ..... 335/202, 6, 16, 335/147, 132; 200/293–308

(56) References Cited

U.S. PATENT DOCUMENTS 4,862,125 * 8/1989 Maier et al. ..... 335/202
4,970,482 * 11/1990 Jacobs et al. ..... 335/201
5,910,760 6/1999 Malingowski et al. .

* cited by examiner

*Primary Examiner*—Lincoln Donovan
(74) *Attorney, Agent, or Firm*—Martin J. Moran

(57) ABSTRACT

The secondary cover of a molded case electric power switch housing is removably secured in place to enclose cavities in a primary cover for auxiliary devices by quick release fasteners. These quick release fasteners have a shaft with self taping threads which engage mounting holes in the top face of the primary cover. In an unlatched position, the non-circular heads register with complimentary non-circular apertures in the secondary cover which passes down over the heads of the quick release fasteners and seats on the top face of the primary cover. The quick release fasteners are then rotated clockwise ¼ turn by a tool to a latched position to clamp down on the secondary cover. A pair of diametrically opposite arcuate recesses in the secondary cover at each non-circular aperture assure that the quick release fasteners can only be rotated clockwise to the latched position as side walls of these recesses form stops at the ¼ turn position.

14 Claims, 3 Drawing Sheets

MOLDED CASE POWER SWITCH WITH SECONDARY COVER REMOVABLY SECURED BY QUICK RELEASE FASTENERS

BACKGROUND OF THE INVENTION

1. Field of the Invention

This invention relates to power switches for interrupting current in electric power circuits. More particularity, it relates to molded cases for such switches having a removable secondary cover which encloses recesses for auxiliary devices in a primary cover, and quick release devices for removably securing the secondary cover over the primary cover.

2. Background Information

Power switches, such as circuit breakers, transfer switches and the like, used in low voltage (600 volts and below) electric power distribution systems commonly have a housing molded of an electrically insulative resin and are, therefore, referred to as molded case circuit breakers, transfer switches and the like. The molded housing includes a base and a cover which together form an enclosure in which are mounted one or more switch poles, a switch operating mechanism and, where appropriate, a trip device. Typically, the molded case circuit breaker has a trip device that responds to short circuits and usually to persistent over current conditions also, and opens the main switch contacts to interrupt the current.

Often, it is desirable to provide additional features on the switch, sometimes as options. Such additional features can include a remote trip, an auxiliary switch which provides an indication of the open or closed state of the main switch contacts, and/or a bell alarm which provides an indication that the trip device has been activated. In some installations, it is desirable to have the switch opened on under voltage or off frequency conditions to prevent damage to a protected load.

These additional features can be incorporated within the switch housing formed by the base and cover. However, in some instances, the devices providing the desired features are received in cavities formed in the cover of the housing. In this later case, a secondary cover encloses the cavities in what has become the primary cover. This secondary cover should be easily removable for inserting, removing or servicing the devices providing the additional features. Typically, the secondary cover is removably secured to the molded housing by screws. However, screws either require threaded inserts in the housing, which increases the cost and manufacturing steps required, or when self tapping screws are used, the threads in the molded resin can be stripped out with repeated insertion and removal. In either case, the screws can be lost when removed. One solution to the lost screw problem is to have fasteners that are retained in the secondary cover; however, these too add to the cost and manufacturing effort required.

There is a need, therefore, for an improved molded case power switch housing and particularly for an improved arrangement for removably attaching a secondary cover to the molded housing.

There is a further need for such an improved molded case power switch housing in which there are no loose fasteners to become lost or hard to locate.

There is an additional need for such an improved molded case power switch which eliminates the manufacturing steps and costs associated with providing tapped inserts or specialized fasteners captured on the secondary cover.

There is another need for such an improved molded case power switch that does not require repeated insertion and removal of self-tapping screws into the molded housing.

There is yet another need for an improved molded case power switch housing which is economical to manufacture and easy to use.

SUMMARY OF THE INVENTION

These needs and others are satisfied by the invention which is directed to a molded case power switch housing in which a secondary cover is removably secured over the primary cover to enclose cavities in the primary cover containing auxiliary devices by at least one, and preferably a plurality, of quick release fasteners having threaded shafts which are threaded into mounting holes in the molded primary cover. The quick release fastener or fasteners also have a non-circular head. A secondary cover has complimentary non-circular apertures which register with the non-circular heads of the quick release fasteners in a first rotational position of the fasteners, such that the secondary cover passes over the non-circular heads of the quick release fasteners and seats on the top face of the primary cover. With the quick release fasteners rotated out of registration with the non-circular apertures in the secondary cover, the non-circular heads overlap and clamp down upon the secondary cover to secure it in place over the top face of the primary cover.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

The invention will be described as applied to a housing for a molded case circuit breaker; however, it will become evident that the invention has application to molded case housings for other types of power switches such as for instance, transfer switches or disconnect switches.

Figure 1:
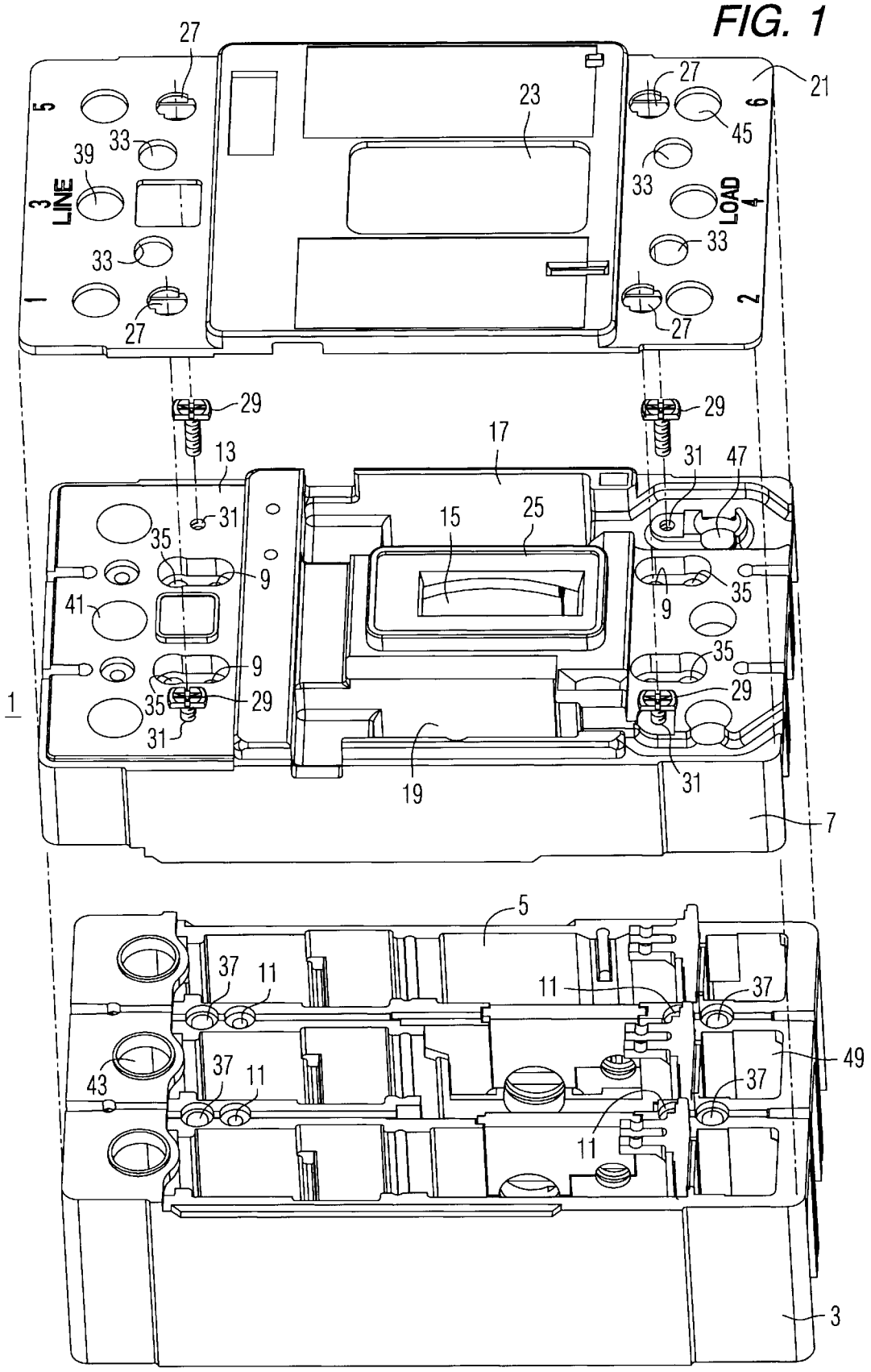
FIG. 1 is an exploded isometric view of a molded case circuit breaker housing in accordance with the invention.
Figure 2:
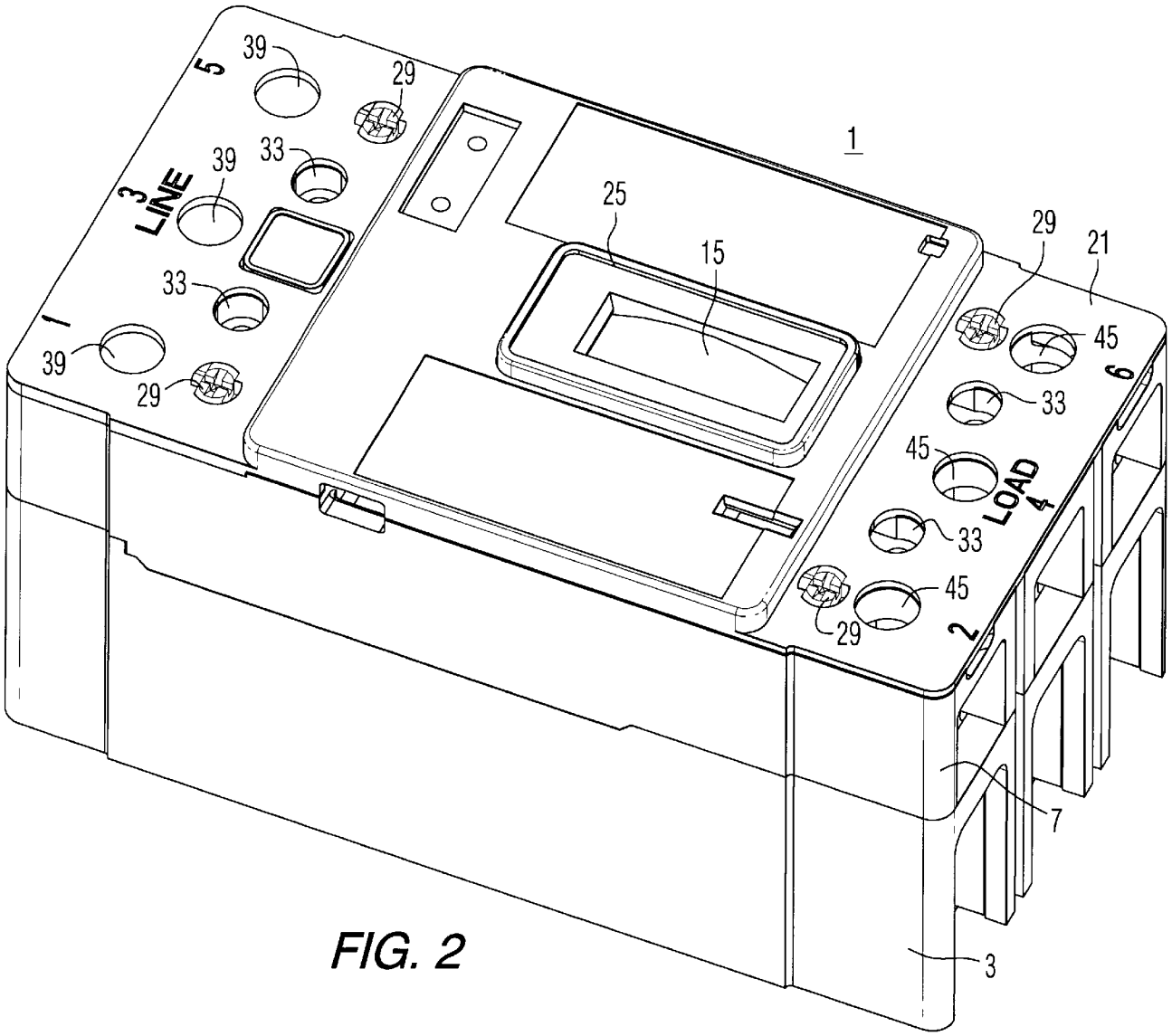
FIG. 2 is an assembled isometric view of the molded case circuit breaker housing of FIG. 1

Referring to FIGS. 1 and 2, the molded case circuit breaker housing 1 includes a molded base 3 having an open top 5. The housing 1 also includes a molded primary cover 7 which seats over the open top 5 of the base 3 to form an enclosure in which poles and an operating mechanism (neither shown) are housed. The primary cover 7 is secured to the base 3 by screws (not shown) which extend through openings 9 in the top cover and are threaded into mating holes 11 in the base as is well known. The top face 13 of the primary cover 7 has an opening 15 for a handle of the operating mechanism (not shown). This top face 13 of the primary cover 7 also has one or more cavities 17 and 19 in which auxiliary devices such as an under voltage relay, a shunt trip module, an auxiliary switch, a bell alarm, or the like (none shown) can be inserted to provide optional functions for the circuit breaker.

The molded case circuit breaker housing 1 further includes a secondary cover 21 which seats on the primary cover 7 and covers the cavities 17 and 19 to enclose any auxiliary devices provided in these cavities. The secondary cover 21 has a handle opening 23 which registers with the handle opening 15 in the primary cover but is larger so that the escutcheon 25 around the handle opening 15 projects through the handle opening 23.

The secondary cover 21 has one or more, in this case four, non-circular apertures 27 through which quick release fasteners 29 extend into mounting holes 31 in the primary cover to secure the secondary cover to the primary cover. The secondary cover has additional apertures 33 which align with corresponding apertures 35 in the top cover and 37 in the base and through which elongated fasteners (not shown) can extend to secure the entire multi-case circuit breaker housing 1 to a panel or other mounting structure. In addition, the secondary cover 21, primary cover 7, and base 3 have aligned line terminal holes 39, 41 and 43, respectively, through which a tool such as screwdriver or Allen wrench (not shown) can be inserted to tighten or loosen line terminals (not shown) mounted in the base 3. Similarly, load terminal holes 45 and 47 at the opposite ends of the secondary cover 21 and primary cover 7, respectively, permit access to load terminals (not shown) in recesses 49 in the base 3.

The secondary cover is easily removable to provide access for installing, removing and servicing the auxiliary devices mounted in the cavities 17 and 19 in the top cover. To this end, the secondary cover 21 is secured over the primary cover 7 by a plurality of the quick release fasteners 29. Each quick release fastener 29 includes a threaded shaft 51. The threads 53 on the shaft 51 are self-tapping so that they can be threaded into a mounting hole 31 in the top face 13 of the primary cover 7. Each quick release fastener 29 has a noncircular head 55 on the threaded shaft 51. While the non-circular head 55 may take various forms, in the preferred embodiment, a circular head is made non-circular by a pair of flats 57 extending parallel to a common diameter of the head. The upper face 59 of the non-circular head 55 is configured to be engaged by a tool (not shown). Preferably, the head 55 is configured to be engaged by a flat blade or a Phillips screwdriver. To this end, the head 55 is provided with a longitudinal slot 61 and an orthogonally intersecting transverse slot 63. The intersection of these slots is recessed at 65 to accommodate the Phillips screwdriver.

Figure 3:
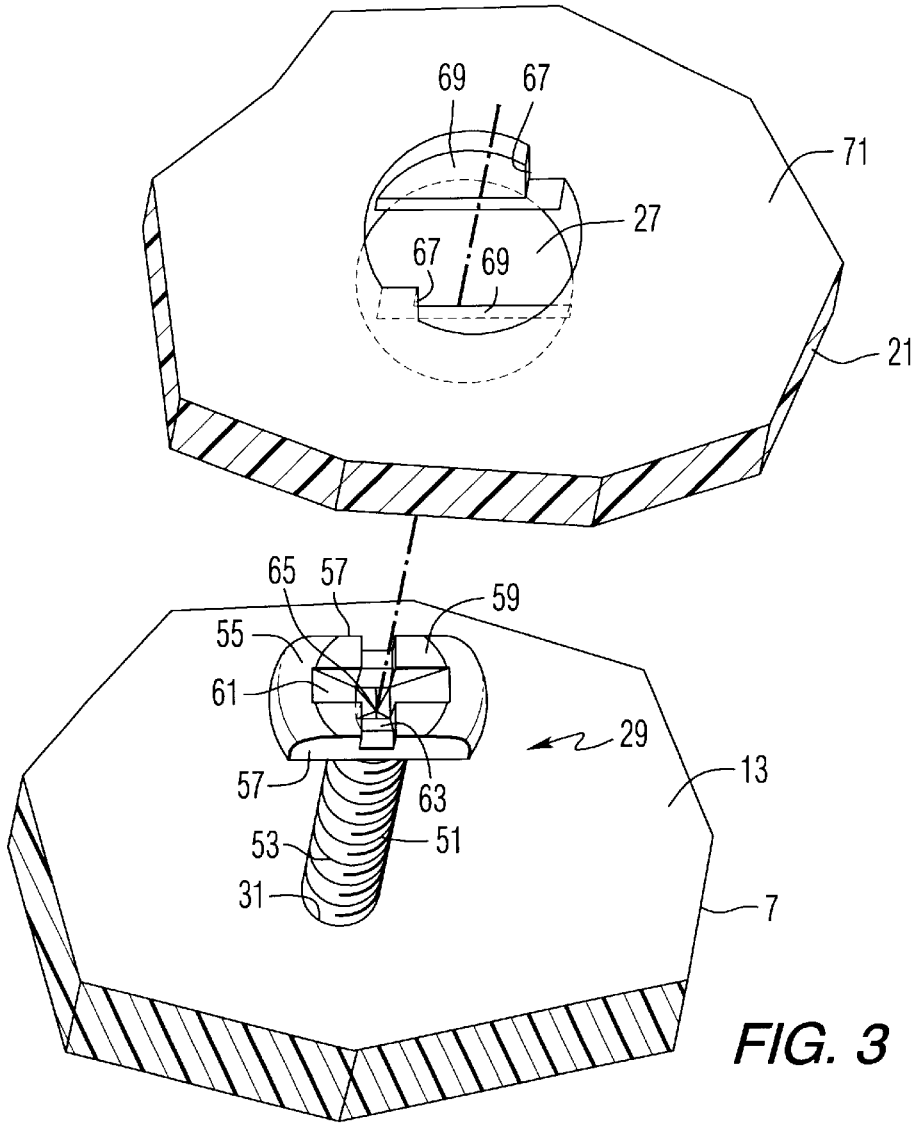
FIG. 3 is a fragmentary isometric view illustrating the arrangement for securing the secondary cover of the molded case circuit breaker housing of FIGS. 1 and 2 to the primary cover in accordance with the invention.
Figure 4:
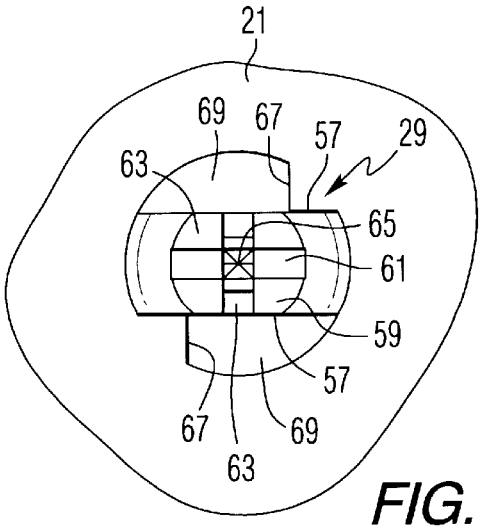
FIG. 4 is a fragmentary plan view showing the first or unlatched position of the quick release fastener which secures the secondary cover to the primary cover.
Figure 5:
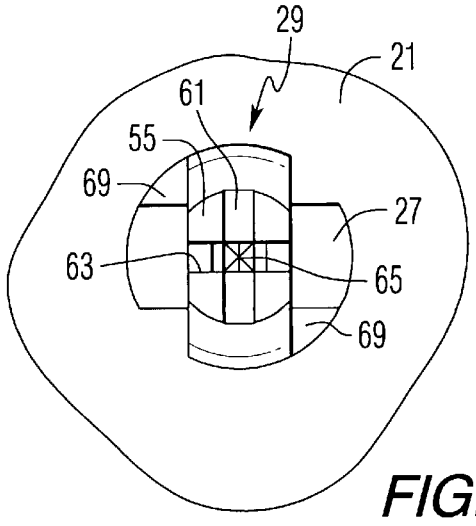
FIG. 5 is a view similar to FIG. 4 but showing the quick release fastener rotated ¼ turn to the locked or latched position.

The plurality of non-circular apertures 27 in the secondary cover 21 are configured to be complimentary to the configuration of the non-circular head 55 on the quick release fasteners 29. Thus, with the quick release fasteners 29 rotated to a first rotational position in which the non-circular heads 55 register with the non-circular apertures 27 as shown in FIGS. 3 and 4, the secondary cover 21 passes over the quick release fasteners 29 and seats on the top face 13 of the primary cover 7. The non-circular heads are then engaged by a tool, such as in the exemplary embodiment a flat blade or a Phillips screwdriver and rotated to a second rotational position where they are out of registration with the non-circular apertures 27 as shown in FIG. 5.

Preferably, this second position is 90 degrees or ¼ turn from the first position so that the non-circular head overlays the secondary cover and clamps it in place. As the self-tapping threads 53 on the quick release fasteners 29 are right handed threads, the quick release fasteners are rotated clockwise from the first, or unlatched position, to the second, or latched position, so that the head 55 clamps down on the secondary cover in the latched position.

In order to set the second or latched position of the quick release fasteners 29, a stop is molded on the secondary cover 21. In the exemplary embodiment, the stop is formed by the walls 67 on the clockwise edges of a pair of diametrically opposite arcuate recesses 69 in the top face 71 of the secondary cover 21. In addition to forming the stops which set the second rotational position of the quick release fasteners, the acute recesses 69 assure that the quick release fasteners 29 can only be rotated clockwise from the unlatched to latched position which thereby assures that a clamping force is applied to the secondary cover.

With the described arrangement, the quick release fasteners 29 remain in the mounting holes 31 in the primary cover 7 and are only rotated ¼ turn, clockwise to latch, and counter clockwise to unlatch the secondary cover 21. As the quick release fasteners 29 are not removed in order to remove the secondary cover, they cannot be lost or misplaced. Also, since they are only rotated one-quarter turn, there is less tendency to wear out the threads in the resin forming the primary cover than there presently is with self tapping screws which must be fully removed and re-started each time the secondary cover is to be removed and re-installed.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed:

1. A molded case power switch housing comprising:

a molded base having an open top;

a primary cover extending over said open top and secured to said molded base to form an enclosure, said primary cover having at least one cavity formed in a top face thereof and at least one mounting hole in said top face;

at least one quick release fastener having a threaded shaft partially threaded into said at least one mounting hole in said primary cover, and a non-circular head on said threaded shaft; and a removable secondary cover having at least one non-circular aperture complimentary to said non-circular head on said at least one quick release fastener and aligned such that with said at least one quick release fastener rotated to a first position said non-circular aperture in said secondary cover registers with said non-circular head on said at least one quick release fastener and said secondary cover passes over said non-circular head and seats on said top face of said primary cover and covers said at least one cavity in said top cover, said secondary cover being secured in place over said primary cover by rotation of said at least one quick release fastener to a second position out of registration with said non-circular aperture in said secondary cover such that said non-circular head overlaps and clamps down upon said secondary cover adjacent said at least one non-circular opening.

2. The molded casing power switch housing of claim 1 wherein said primary cover has a plurality of mounting holes in said top face, and said at least one quick release fastener comprises a plurality of quick release fasteners having threaded shafts threaded into said plurality of mounting holes.

3. The molded case power switch housing of claim 2 wherein said threaded shafts comprise self-threading shafts.

4. The molded case power switch housing of claim 3 wherein said non-circular head of each of said plurality of quick release fasteners comprises a circular member with a pair of opposed flat sides.

5. The molded case power switch housing of claim 4 wherein said non-circular head is configured to be engaged by a tool.

6. The molded case power switch housing of claim 5 wherein each said non-circular head is configured to be engaged by both a flat blade and a Phillips screwdriver.

7. The molded case power switch housing of claim 1 wherein said non-circular head comprises a circular member with a pair opposed flat sides.

8. The molded case power switch housing of claim 1 wherein said non-circular head is configured to be engaged by both a flat blade and a Phillips screwdriver.

9. The molded case power switch housing of claim 1 wherein said removable secondary cover has a stop engaging said non-circular head to set said second position of said at least one quick release fastener.

10. The molded case power switch housing of claim 9 wherein said stop is positioned such that said at least one quick release fastener rotates about ¼ turn between said first position and second position.

11. The molded case power switch housing of claim 9 herein said stop is formed by an edge wall of a recess formed in a top face of said secondary cover.

12. The molded case power switch housing of claim 11 wherein said non-circular head of said at least one quick release fastener comprises a circular member with a pair of opposed flat sides and said stop member is formed by edge walls of a pair of diametrically opposed arcuate recesses in said top face of said secondary cover.

13. The molded case power switch housing of claim 12 wherein said pair of diametrically opposed arcuate recesses are positioned such that said at least one quick release fastener rotates about ¼ turn between said first position and said second position.

14. The molded case power switch housing is claim 13 wherein said non-circular head is configured with orthogonally intersecting slots for selective engagement by either a flat blade or a Phillips screwdriver.

* * * * *